US007935912B2

(12) United States Patent
Arima et al.

(10) Patent No.: US 7,935,912 B2
(45) Date of Patent: May 3, 2011

(54) CERAMIC HEATER, AND GLOW PLUG USING THE SAME

(75) Inventors: Hiroyuki Arima, Kirishima (JP); Masao Yoshida, Kirishima (JP)

(73) Assignee: Kyocera Corporation, Kyoto (JP)

( * ) Notice: Subject to any disclaimer, the term of this patent is extended or adjusted under 35 U.S.C. 154(b) by 402 days.

(21) Appl. No.: 11/569,675

(22) PCT Filed: Feb. 25, 2005

(86) PCT No.: PCT/JP2005/003185

§ 371 (c)(1),
(2), (4) Date: Aug. 18, 2008

(87) PCT Pub. No.: WO2005/117492

PCT Pub. Date: Dec. 8, 2005

(65) Prior Publication Data

US 2008/0302776 A1 Dec. 11, 2008

(30) Foreign Application Priority Data

May 27, 2004 (JP) ..... P 2004-158434

(51) Int. Cl.
*F23Q 7/22* (2006.01)

(52) U.S. Cl. ..... 219/270; 219/260

(58) Field of Classification Search ..... 219/260–270
See application file for complete search history.

(56) References Cited

U.S. PATENT DOCUMENTS

| | | | | |
|---|---|---|---|---|
| 5,750,958 | A | 5/1998 | Okuda et al. | |
| 5,852,280 | A * | 12/1998 | Mizuno | 219/270 |
| 6,468,174 | B1 | 10/2002 | Brandsma et al. | |
| 6,468,374 | B1 | 10/2002 | Kar et al. | |
| 6,479,129 | B1 | 11/2002 | Kar et al. | |
| 6,548,142 | B1 | 4/2003 | Kar et al. | |

FOREIGN PATENT DOCUMENTS

| | | | |
|---|---|---|---|
| CN | 1199821 | A | 11/1998 |
| EP | 0869698 | A1 | 10/1998 |
| JP | 01137585 | A | 5/1989 |
| JP | 07-220859 | | 8/1995 |
| JP | 07-318055 | | 12/1995 |
| JP | 10332149 | A | 12/1998 |
| JP | 2000-121055 | | 4/2000 |
| JP | 2001-043962 | | 2/2001 |
| JP | 2001-324141 | | 11/2001 |
| JP | 2002-122326 | | 4/2002 |
| JP | 2002122326 | A | 4/2002 |
| JP | 2002-537203 | | 11/2002 |

(Continued)

OTHER PUBLICATIONS

European search report for corresponding European application 05710735.1-2214 lists the references above.

(Continued)

*Primary Examiner* — Daniel Robinson
(74) *Attorney, Agent, or Firm* — DLA Piper LLP (US)

(57) ABSTRACT

The protrusion 16 is formed on one end face of the ceramic member 11, and the positive electrode lead-out section 13*a* which is electrically connected to the heat generating member 12 is drawn out and exposed on the side face of the protrusion 16 at several positions, while the terminal 14 of the positive electrode lead-out fixture can be connected to each of the exposed portions.

4 Claims, 14 Drawing Sheets

FOREIGN PATENT DOCUMENTS

| | | | |
|---|---|---|---|
| JP | 2002-537205 | | 11/2002 |
| JP | 2002-353481 | | 12/2002 |
| JP | 2003130349 | A | 5/2003 |
| JP | 2003-309303 | | 10/2003 |
| JP | 2003303762 | A | 10/2003 |
| JP | 2005-071943 | | 3/2005 |

OTHER PUBLICATIONS

Chinese language office action and its English language translation for corresponding Chinese application 200580016724.4 lists the references above.

* cited by examiner

CERAMIC HEATER, AND GLOW PLUG USING THE SAME

CROSS-REFERENCE TO THE RELATED APPLICATIONS

This application is a national phase of international application No. PCT/JP2005/003185 filed Feb. 25, 2005, the entire contents of which are incorporated by reference. This application also claims benefit of priority under 35 U.S.C. §119 to the Japanese Patent Application 2004-158434 filed May 27, 2004, the entire contents of which are incorporated by reference.

BACKGROUND OF THE INVENTION

1. Field of the Invention

The present invention relates to a ceramic heater and a glow plug which employs the same. More particularly, the present invention relates to a ceramic heater to be used for igniting a kerosene stove with air circulation fan, and to a glow plug which employs the ceramic heater and is used for assisting the startup of a diesel engine or the like.

2. Description of the Related Art

There has been a trend in recent years of shifting the combustion method of diesel engine from a system provided with an auxiliary combustion chamber to direct fuel injection. There is also a trend to employ multiple valves. The glow plug used in a diesel engine of direct fuel injection system is disposed to penetrate the wall of a cylinder head and face a main combustion chamber. Wall thickness of the cylinder head cannot be made too small, as the cylinder head must have a certain level of strength.

For the reasons described above, the diesel engine of direct fuel injection system has very narrow and long hole through which a glow plug is inserted. In other words, it is important that the glow plug used in the diesel engine of direct fuel injection system be longer and thinner than the one of the conventional type which preheats the auxiliary combustion chamber.

In order to meet the requirement for a longer glow plug and reduce the length of the ceramic heater so as to cut down on the cost, a glow plug having such a structure has been proposed as the ceramic heater is secured at one end of an outer tube made of metal so that a heat generating portion of the ceramic heater protrudes to the outside.

For example, Japanese Unexamined Patent Publication (Kokai) No. 2002-122326 (p8, FIG. 1) describes a glow plug having an outer tube made of metal joined at the distal end thereof, wherein a ceramic heater is secured by means of glass on an opening at the distal end of the outer tube made of metal. The ceramic heater has a heat generating resistive member, such as coil made of a metal having high melting point (for example, tungsten) or an electrically conductive ceramics, embedded at one end of a cylindrical ceramic member made of an electrically insulating ceramics. The heat generating resistive member has a positive lead wire and a negative lead wire connected thereto. A round protrusion is formed at an end of the ceramic member on the side opposite to that where the heat generating resistive member is embedded, and the distal end of the positive lead wire is exposed on the side face of the protrusion. The negative lead wire is exposed on the side face of the ceramic member.

Connected to the distal end of a positive electrode lead-out fixture of the glow plug is a terminal formed in a cup shape (bottomed tube shape). The cup-shaped terminal of the positive electrode lead-out fixture is fitted into the protrusion formed at the end face of the ceramic heater and joined together by brazing. This establishes electrical connection between the positive electrode lead-out fixture of the glow plug and the positive lead wire of the ceramic heater. The negative lead wire exposed on the side face of the ceramic member is connected to the outer tube made of metal of the glow plug.

The ceramic heater described above can be manufactured as follows. The ceramic heater is sintered by firing with the positive lead wire disposed at a position offset from the center. After sintering, the ceramic heater is ground or otherwise machined on the end face so as to form a protrusion, such that the distal end of the positive lead wire is exposed on the side face of the round protrusion.

Japanese Unexamined Patent Publication (Kokai) No. 2001-324141 describes a glow plug having a positive lead wire of a ceramic heater and a positive electrode lead-out fixture connected with each other via a connection hole. Specifically, the ceramic member has the connection hole formed at the rear end thereof, and the positive electrode lead-out fixture is inserted into the connection hole and is connected to the positive lead electrode. The connection hole (positive electrode lead-out hole) is formed by sintering while the hole is filled with a metal having high melting point such as Mo, and dissolving the metal such as Mo by means of an acid.

SUMMARY OF THE INVENTION

In such a structure according to Japanese Unexamined Patent Publication (Kokai) No. 2002-122326 (p8, FIG. 1), where the distal end of the positive lead wire is exposed on the side face of the protrusion formed at the rear end of the ceramic member and the cup-shaped terminal of the positive electrode lead-out fixture is engaged with the protrusion and joined together by brazing, localized heating tends to occur around the terminal of the positive electrode lead-out fixture thus resulting in degradation of durability of the ceramic heater under current.

Also in such a structure according to Japanese Unexamined Patent Publication (Kokai) No. 2001-324141, where the ceramic member has the connection hole formed at the rear end thereof, while the positive lead wire and the positive electrode lead-out fixture are connected with each other via the connection hole, sufficient durability cannot be ensured for the ceramic heater. In case the connection hole is formed by embedding the metal having high melting point in the ceramic member and firing while applying uniaxial pressure by means of a hot press, the metal having high melting point undergoes plastic deformation by the pressure into oval shape. This generates residual stress in the ceramics around the metal having high melting point during firing. When the metal having high melting point is removed after firing, the residual stress is released and causes crack around the connection hole (electrode lead-out hole) from which the metal having high melting point has been removed. As a result, durability and reliability of heat resistance of the ceramic heater deteriorate. Also the process of dissolving and removing the metal having high melting point such as Mo used as the hole forming member by means of an acid poses such problems as the time required by the process and the disposal of waste liquid in a large amount.

The present invention has been made to solve the problems described above, and has an object of providing a ceramic heater having high durability and high reliability of heat resistance and a glow plug which employs the ceramic heater.

A first aspect of the present invention is a ceramic heater comprising a heat generating resistive member incorporated in a rod-shaped ceramic member and a pair of positive lead wire and negative lead wire which are connected to the heat generating resistive member, wherein a lead-out section is formed at the distal end of the positive lead wire, and the lead-out section is exposed on the side face of the protrusion, which is formed at one end face of the ceramic member, at a plurality of positions along the side face. The lead-out section is preferably exposed at positions which oppose each other on the side face of the protrusion.

The lead-out section connected to the positive lead wire which is drawn out of the heat generating resistive member is drawn out and exposed at a plurality of positions on the side face of the protrusion, so that the terminals of the positive electrode lead-out fixture can be connected to the exposed portions of the lead-out section. Therefore, even when a high voltage is applied via the positive electrode lead-out fixture, it is made possible to prevent the electric current from concentrating in the junction between the positive electrode lead-out fixture and the positive lead wire (positive electrode lead-out section) and suppress heat from being generated in the positive electrode lead-out section. Thus although heat generated by the heater will not be fully distributed in the ceramic member immediately after supplying electric power, temperatures of the positive electrode lead-out section and the ceramic member are suppressed from differing too much from each other. As a result, the ceramic heater having high thermal shock resistance and high durability under voltage is provided. Thus a glow plug which employs the ceramic heater of high thermal shock resistance can have greatly improved reliability without ignition failure.

A second aspect of the present invention is a ceramic heater comprising a main body formed from electrically insulating ceramics, a heat generating resistive member embedded in the main body at the distal end thereof, a pair of positive lead wire and negative lead wire which are connected to the heat generating resistive member and an electrode lead-out hole formed in the base end of the main body for securing the positive electrode lead-out fixture onto the positive lead wire, wherein the electrode lead-out hole has substantially circular cross section, and the ratio of minor axis length B to major axis length A of the cross section satisfies a relation of $0.8 \leqq B/A \leqq 1$. This constitution enables it to reduce the residual stress around the electrode lead-out hole and suppress cracks from occurring. As a result, a ceramic heater having high durability and high reliability of heat resistance can be obtained.

The electrode lead-out hole having such a shape is preferably formed by embedding a hole forming member which would be turned into carbon having density of 1.5 g/cm$^3$ or higher in a green ceramic compact that would become the main body when fired, firing the compact in an inert gas atmosphere or reducing atmosphere, and removing the hole forming member by firing in an oxidizing atmosphere. Instead of removing the hole forming member by firing, water jet may also be preferably employed to remove the hole forming member, in which case the problems of the time required by the process of dissolution by the acid and the disposal of waste liquid are eliminated.

It is also preferable that a reaction layer with the hole forming member is provided around the electrode lead-out hole, and more preferably the main body is formed from silicon nitride ceramics and SiC is provided as the reaction layer. Such a constitution may also be employed as the main body is formed from silicon nitride ceramics and the hole forming member is coated with boron nitride on the surface thereof.

The word "embedded" as used herein means not only the embedding of a solid object but also incorporation of a paste which is fired.

According to the present invention, the ceramic heater having high durability and high reliability of heat resistance and the glow plug which uses the ceramic heater can be provided.

DESCRIPTION OF REFERENCE NUMERALS

Figure 1A:
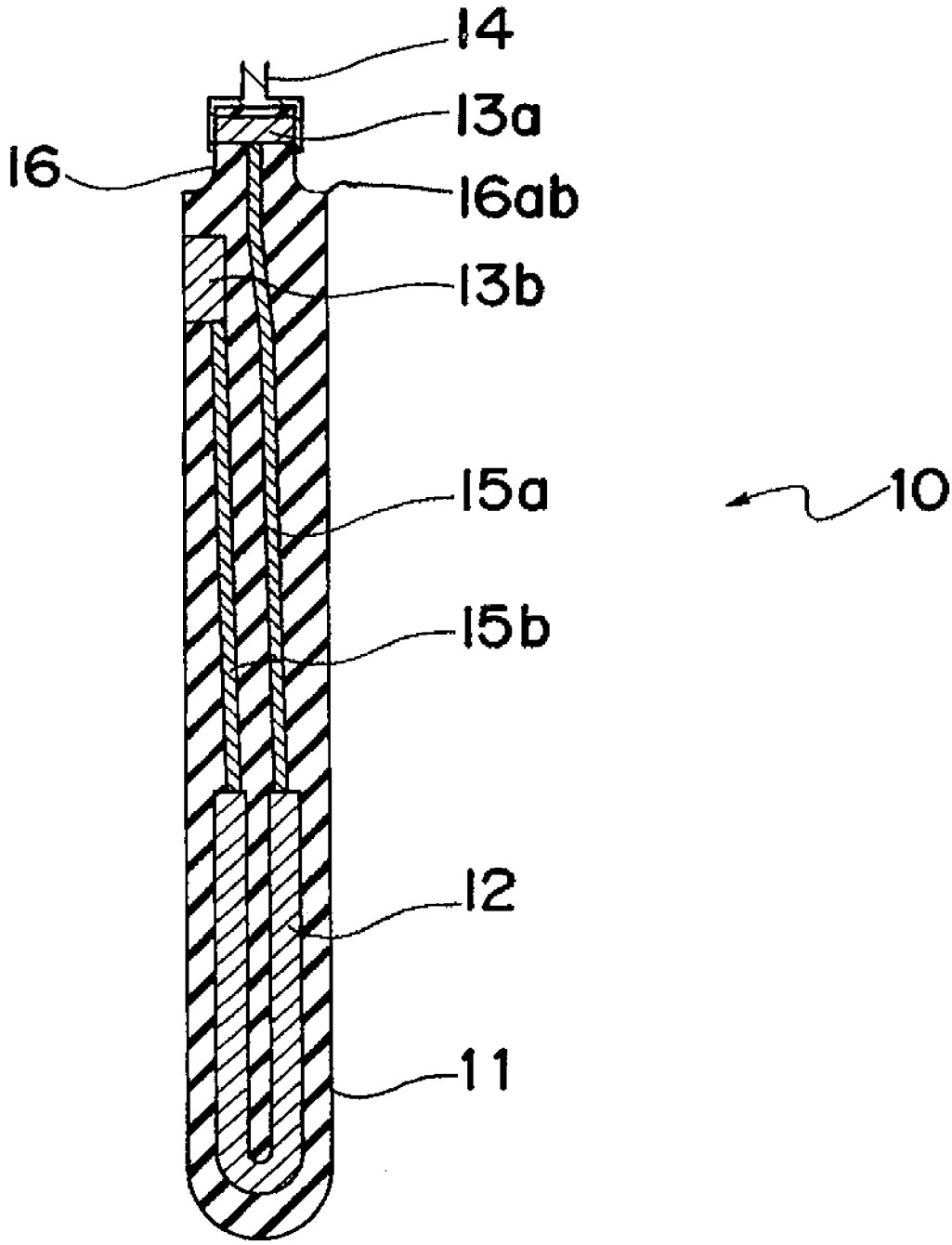
FIG. 1A is a sectional view of a ceramic heater according to first embodiment of the present invention.

10: ceramic heater
11: ceramic member
12: heat generating resistive member
13*a, b*: lead-out section
14: positive electrode lead-out fixture
15*a, b*: lead wire
16: protrusion
18: electrode lead-out hole
20: ceramic heater
22: outer tube made of metal
25: housing
26: glow plug

DETAILED DESCRIPTION OF THE INVENTION

First Embodiment

Ceramic Heater

FIG. 1A is a sectional view of a ceramic heater according to this embodiment. As shown in FIG. 1A, the ceramic heater 10 of this embodiment comprises a heat generating resistive member 12 incorporated in a ceramic member 11, a pair of a positive lead wire 15*a* and a negative lead wire 15*b* which are connected to the heat generating resistive member 12 and lead-out sections 13*a* and 13*b* which are connected to the positive lead wire 15*a* and the negative lead wire 15*b*, respectively, and are exposed on the surface of the ceramic member 11. The lead-out section 13*a* connected to the distal end of the positive lead wire 15*a* is exposed on the side face of the protrusion 16 which is formed on one end of the ceramic member 11, and is connected to the positive electrode lead-out fixture 14. The lead-out section 13*b* connected to the distal end of the negative lead wire 15*b* is exposed on the side face of the ceramic member 11, and is constituted so as to be connected from the outside.

The ceramic member 11 is formed from electrically insulating ceramics in rod shape, and one end face thereof is formed into the protrusion 16. The heat generating resistive member 12 is embedded in the ceramic member 11 at the distal end thereof. The heat generating resistive member 12 is a U-shaped rod, and contains an electrically conductive component, a control component for the control of temperature dependency of resistance and a ceramic component which achieves insulation. The lead-out sections 13*a* and 13*b* are connected to the distal ends of the lead wires 15*a* and 15*b*, respectively, as shown in FIG. 1A. The lead-out section 13*b* connected to the negative lead wire 15*b* is exposed on the side face of the ceramic member 11. The lead-out section 13*a* connected to the positive lead wire 15*a* is drawn out and exposed at two positions on the side face of the protrusion 16.

Connected to the lead-out section 13*a* exposed on the side face of the protrusion 15 is the positive electrode lead-out fixture 14 used for electrical connection with the outside. The positive electrode lead-out fixture 14 may be either a part of the ceramic heater, or a part of an apparatus such as glow plug which incorporates the ceramic heater. The terminal of the positive electrode lead-out fixture 14 is made of SUS304 or the like, and is formed in a cup shape at the distal end thereof. The positive electrode lead-out fixture 14 is constituted so that a predetermined voltage can be applied from the outside to the ceramic heater 10. The terminal of the positive electrode lead-out fixture 14 is formed in a cup shape so as to be surely connected to the lead-out section 13*a* which is exposed at a plurality of positions on the side face of the protrusion 16 of the ceramic member 11, and secure connection can be established even when the number of positions where the lead-out section 13*a* is exposed increases. While the terminal of the positive electrode lead-out fixture 14 in this case is formed in a cup shape at the distal end thereof, the present invention is not limited to this shape. For example, such a constitution may be employed as the distal end of the positive electrode lead-out fixture 14 is branched out and the distal end of each of the branches of the positive electrode lead-out fixture is connected to the respective position where the lead-out section 13*a* is exposed.

When electric power is supplied to the lead-out section 13*a*, the power is supplied to the U-shaped heat generating resistive member 12 which is provided in the ceramic member 11 so as to begin heating of the heat generating resistive member 12, while the heat generated thereby is transferred through the ceramic member 11 and reaches the surface thereof. Immediately after the voltage has been applied through the positive electrode lead-out fixture 14 to the lead-out section 13*a*, heat generated thereby is not fully distributed throughout the ceramic member 11. The current path tends to become narrower in the lead-out section 13*a* which is connected to the positive electrode lead-out fixture 14, making localized heat generation likely to occur. As a result, there occurs a difference in temperature between lead-out section 13*a* and the ceramic member 11 in the protrusion 16 immediately after the voltage has been applied, resulting in lower durability of the ceramic heater 10 under current.

However, in the ceramic heater 10 of this embodiment, the lead-out section 13*a* is exposed at two or more positions on the side face of the protrusion 16, and the terminals of the positive electrode lead-out fixture 14 can be connected to the lead-out section 13*a* at the respective exposed positions. As a result, resistance of the current path in the vicinity of the protrusion 16 can be decreased, thereby suppressing localized heat generation in the lead-out section 13*a* at the start of applying voltage. Thus it is made possible to suppress thermal stress from being generated in the protrusion 16 and improve durability under current.

In a more preferable embodiment, the two positions where the lead-out section 13*a* is exposed are located at the positions which oppose each other via the protrusion 16 as shown in FIG. 1A. In case the lead-out section 13*a* is exposed at three or more positions, it is preferable that the positions of exposure are located at equal distance. When formed at such positions, distance between positions where the lead-out section 13*a* generates heat can be made larger. Thus it is made possible to suppress thermal stress from being generated in the protrusion 16 and improve durability under current further.

The ratio of outer diameter A of the protrusion 16 to outer diameter B of the ceramic member 11 preferably satisfies a relation of $0.4 \leqq A/B \leqq 0.88$. In case the ratio A/B of outer diameters is larger than 0.88, the distance between the exposed position of the lead-out section 13*a* and the center increases and accordingly the resistance of the lead-out section 13*a* increases, thus increasing the possibility of localized heat generation occurring in the protrusion 16 when current rushes in. In case the ratio A/B of outer diameters is smaller than 0.4, load bearing capability of the protrusion 16 decreases, thus increasing the possibility of crack occurring in the protrusion 16.

Each area of the portion where the lead-out section 13*a* is exposed is preferably in a range from $1\times10^5$ through $6.8\times10^5$ $\mu m^2$. When the area of the portion where the lead-out section 13*a* is exposed is less than $1\times10^5$ $m^2$, contact resistance increases between the lead-out section 13*a* and the terminal of the positive electrode lead-out fixture 14, thus resulting in higher thermal stress generated in the protrusion 16 at the beginning of voltage application. When the area of the portion where the lead-out section 13*a* is exposed is larger than $6.8\times10^5$ $\mu m^2$, thermal stress increases in the protrusion 16 between the lead-out section 13*a* and the surrounding ceramics, thus increasing the possibility of crack being generated in the lead-out section 13*a* and the protrusion 16.

Figure 1B:
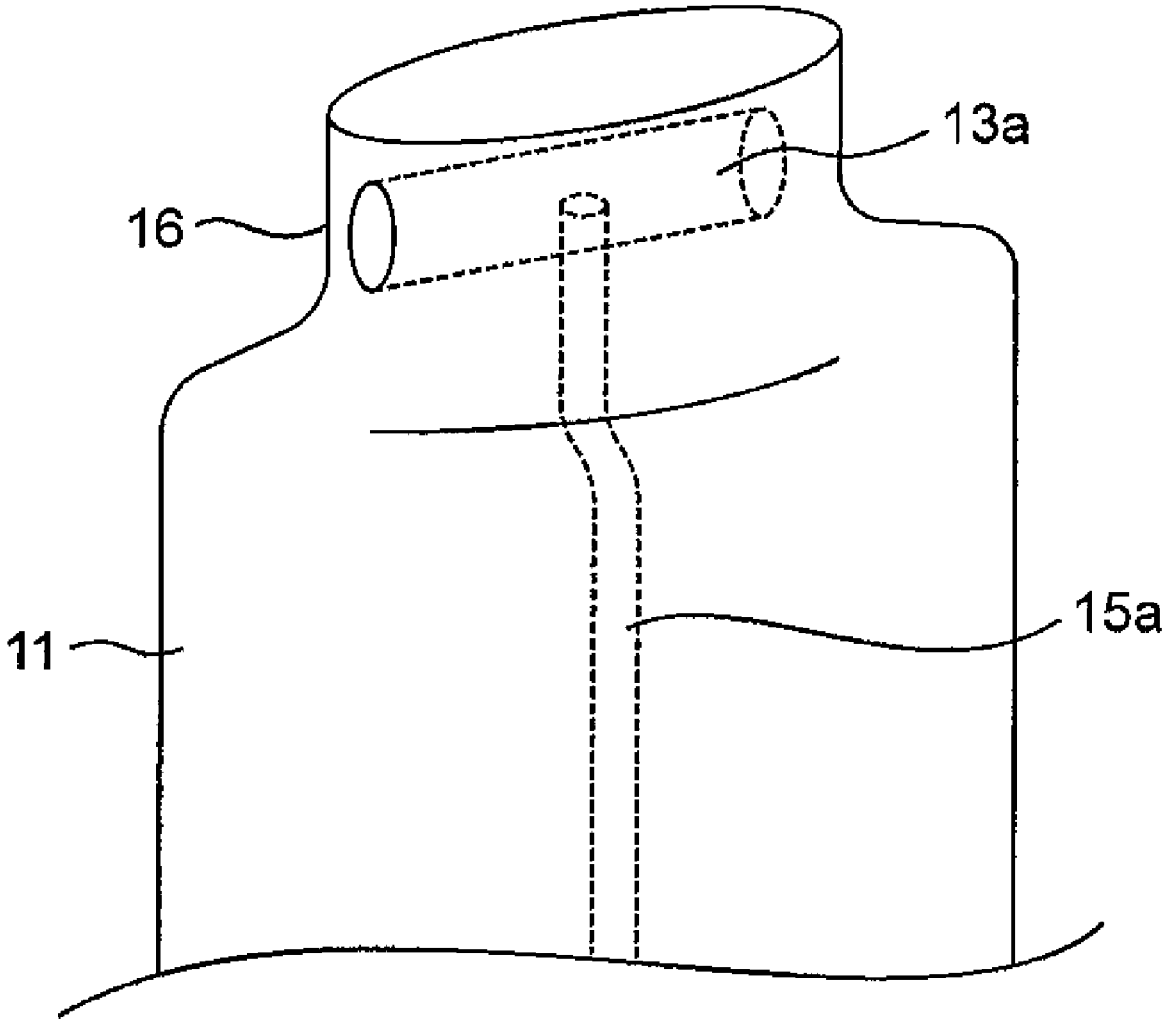
FIG. 1B is an enlarged perspective view of a portion in the vicinity of a protrusion of the ceramic heater shown in FIG. 1A.
Figure 1C:
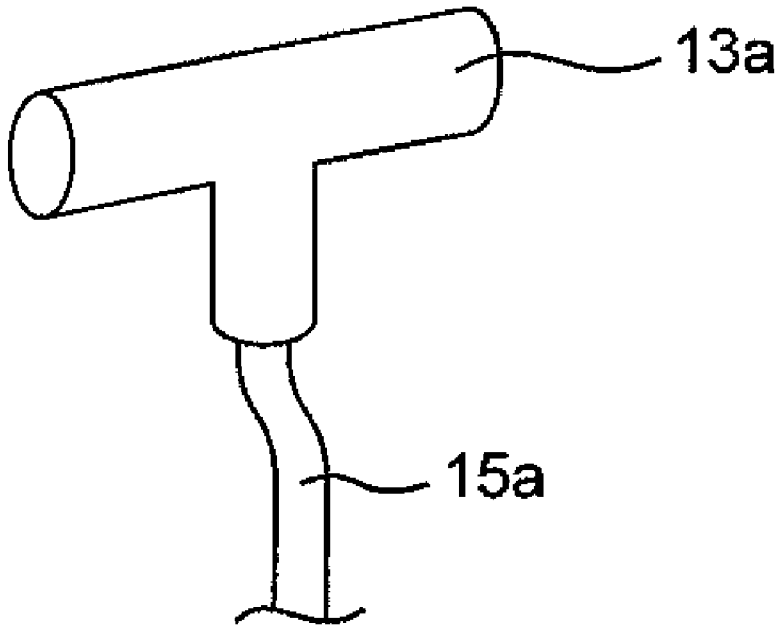
FIG. 1C is a perspective view of a variation of a lead-out section.

The lead-out section 13*a* preferably has such a shape that extends in two directions on a straight line from the center axis of the ceramic member 11 as shown in FIG. 1B. This configuration makes it possible to have the lead-out section 13*a* exposed at opposing two points on the circumferential surface of the protrusion 16. For example, the lead-out section 13*a* may have a cylindrical shape (or plate shape) extending at right angles with the longitudinal direction of the ceramic member 11 as shown in FIG. 1B. Cross section of the ceramic member 11 having cylindrical shape (or plate shape) may have various shapes such as circle, oval, elongated oval, rectangle, spindle shape or hexagon. Moreover, cross section of the ceramic member having cylindrical shape or plate shape may vary from position to position. For example, cross section of the lead-out section 13*a* having plate shape may be elongated rectangle in a region near the center and elongated oval in regions near the ends where it is exposed to the outside from the ceramic member 11. Such a shape that extends in three or more directions from the center axis of the lead-out section 13*a* may also be employed. The lead-out section 13*a* preferably has a larger area of contact with the lead wire so that the contact resistance with the lead wire is lower. For this reason, it is preferable that the portion of the lead-out section 13*a* that contacts the lead wire extends downward. For example, the lead-out section 13*a* may have T-shaped configuration as shown in FIG. 1C.

The lead-out section preferably contains an electrically conductive component and an insulating component in a typical composition. The electrically conductive component is at least one kind of silicate, carbide or nitride of at least one element selected from among W, Ta, Nb, Ti, Mo, Zr, Hf, V and Cr. The insulating component is sintered silicon nitride or the like. When the insulating component contains silicon nitride, in particular, it is preferable that at least one kind of tungsten carbide, molybdenum silicate, titanium nitride or tungsten silicate and the like is used as the electrically conductive component. The electrically conductive component may also be at least one metallic element selected from among W, Ta, Nb, Ti, Mo, Zr, Hf, V and Cr.

The electrically insulating ceramics that constitutes the ceramic member 11 is typically fired together with the heat generating resistive member 12 and the lead wires 15*a*, 15*b*, and is integrated therewith after firing. It suffices that the electrically insulating ceramics has sufficient insulating property with respect to the heat generating resistive member 12 and the lead wires 15*a*, 15*b* at temperatures from −20 to 1500° C. It is particularly preferable to have insulating property 108 times with respect to the heat generating resistive member 12.

While there is no limitation to the component that constitutes the electrically insulating ceramics, nitride ceramics is preferably used. This is because nitride ceramics has relatively high heat conductivity to be capable of efficiently transferring heat from the distal end to the other end of the ceramic member 11, thereby decreasing the temperature difference between the distal end and the other end of the ceramic member 11. For example, the electrically insulating ceramics may be constituted from only one of silicon nitride ceramics, sialon and aluminum nitride-based ceramics or, alternatively, may contain at least one of silicon nitride ceramics, sialon and aluminum nitride-based ceramics as the main component.

Among nitride ceramic materials, silicon nitride ceramics is capable of making a ceramic heater and a glow plug which have high thermal shock resistance and high durability. The silicon nitride ceramics here includes various materials which contains silicon nitride as the main component, including sialon as well as silicon nitride. In addition, several percentage points (about 2 to 10%) by weight of a sintering additive (oxide of Y, Yb, Er or the like) is usually added and fired. There is no limitation to the sintering additive, and powders such as oxide of rare earth element, which are commonly used when firing silicon nitride, may be used. It is particularly preferable to use a powder of sintering additive such as $Er_2O_3$ which develops crystal phase in the grain boundaries, since it enables it to improve the heat resistance.

The ceramic member 11 may also contains borides of the metal elements that constitute the heat generating resistive member 12, which may decrease the difference in thermal expansion coefficient from the heat generating resistive member 12. A small amount of electrically conductive component may also be contained in order to decrease the difference in thermal expansion coefficient from the following electrically conductive component.

The heat generating resistive member 12 typically contains an electrically conductive component and an insulating component. The electrically conductive component is at least one kind of silicate, carbide or nitride of at least one element selected from among W, Ta, Nb, Ti, Mo, Zr, Hf, V and Cr. The insulating component is sintered silicon nitride or the like. When the insulating component contains sintered silicon nitride, in particular, it is preferable that at least one kind of tungsten carbide, molybdenum silicate, titanium nitride and tungsten silicate.

It is preferable that the electrically conductive component has a thermal expansion coefficient which has smaller difference from those of the insulating component contained in the heat generating resistive member 12 and the ceramic member which is an insulator. Melting point of the electrically conductive component is preferably higher than the operating temperature of the ceramic heater (1400° C. or higher, more particularly 1500° C. or higher). While there is no limitation on the proportion of the electrically conductive component and the insulating component contained in the heat generating resistive member 12, proportion of the electrically conductive component is preferably from 15 to 40% by volume, more preferably from 20 to 30% by volume of the heat generating resistive member 12. When the content of the electrically conductive component is less than 15% by volume, there is very small possibility of the electrically conductive component making contact with each other, thus resulting in excessively high resistance of the heat generating resistive member 12 and significantly low durability. When the content of the electrically conductive component is more than 40% by volume, thermal expansion coefficient of the heat generating resistive member 12 becomes too higher than the thermal expansion coefficient of the main body 11, thus resulting in low durability.

(Glow Plug)

Figure 2:
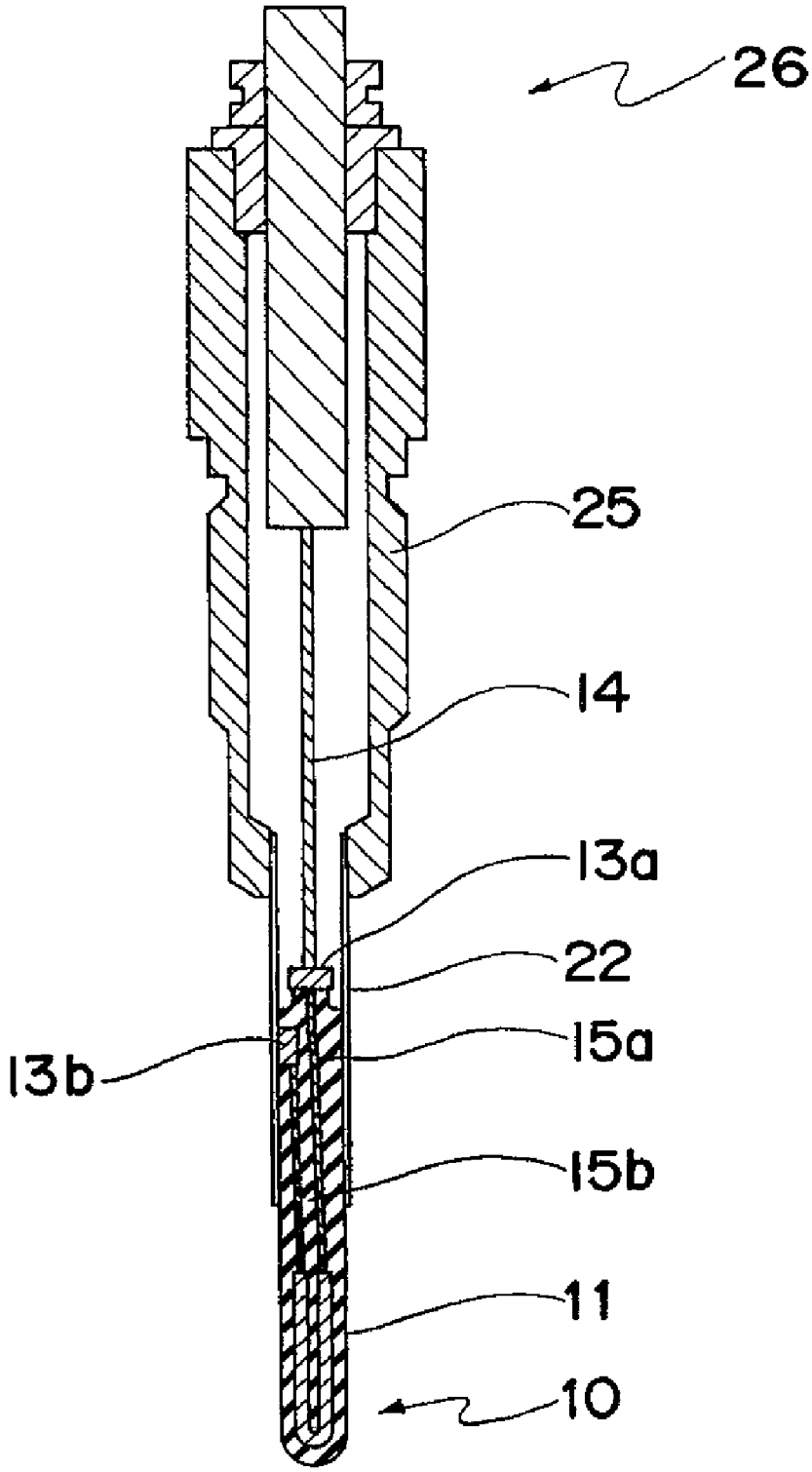
FIG. 2 is a sectional view of a glow plug having the ceramic heater shown in FIG. 1A.

The glow plug that employs the ceramic heater shown in FIG. 1A will now be described. The glow plug 26 shown in FIG. 2 comprises an outer tube made of metal 22 which is held at the distal end of a housing 25. The outer tube made of metal 22 is made of an electrically conductive material such as stainless steel. Since the outer tube made of metal 22 has a function to serve as a grounding electrode, it is made possible to supply electric power through the outer tube made of metal 22 by attaching the outer tube made of metal 22 to other member. The ceramic heater 10 is fitted into the opening of the outer tube made of metal 22 located at the distal end thereof, and is secured in place by brazing. The negative electrode lead-out section 13*b* which is exposed on the side face of the ceramic heater 10 is electrically connected by brazing with the inside of the outer tube made of metal 22 of the glow plug. On the other hands the plurality of positive electrode lead-out sections 13*a* which are exposed on the protrusion 16 of the ceramic heater 10 are connected with the positive electrode lead-out fixture 14 of the glow plug.

With the glow plug of this embodiment, current can be prevented from concentrating in the positive electrode lead-out fixture 14 and the positive electrode lead-out section 13*a* and it is made possible to suppress heat generation from the positive electrode lead-out section 13*a*, even when a high voltage is applied through the positive electrode lead-out fixture 14. Thus although heat generated by the heater will not be fully distributed in the ceramic member immediately after supplying electric power temperatures of the positive electrode lead-out fixture and the ceramic member are suppressed from differing too much from each other. As a result, it becomes less likely that malfunction and failure are caused by thermal shock even a high voltage is applied to the ceramic heater 10 during ignition of the glow plug. That is, the glow plug having greatly improved reliability without ignition failure can be provided.

(Method for Manufacturing Ceramic Heater and Glow Plug)

A method for manufacturing the ceramic heater and the glow plug employing the same of this embodiment will now be described.

First, the method for manufacturing the ceramic heater 10 will be described.

A paste which contains an electrically conductive component and an insulating component is prepared as the material to form a heat generating resistive member 12. Total content of the electrically conductive component and the insulating component is preferably from 75 to 90% by weight of the entire paste. The paste can be made, for example, by mixing powders of predetermined amounts of these components in wet process, drying the mixture and mixing it with a binder such as polypropylene, wax or the like. The paste may be dried and formed into pellets or other form so as to make it easier to handle.

The paste prepared as described above is formed into the shape of the heat generating resistive member 12 while embedding the lead wires 15*a*, 15*b*. While there is no limitation on the method of embedding the lead wires 15*a*, 15*b* in the paste, for example, the lead wires 15*a*, 15*b* may be secured in a mold which has the shape of the heat generating resistive member so as to protrude into the cavity into which the paste is poured. Alternatively, the lead wires 15*a*, 15*b* may be put into a compact of the paste formed into the shape of the heat generating resistive member 12. The lead-out section 13*a* can be made by pouring the paste into mold having the shape of the lead-out section, and at the same time the heat generating resistive member 12 is formed. Alternatively, a paste prepared by mixing a binder may be applied by screen printing or the like onto a rod-shaped ceramic compact thereby forming the lead wires 15*a*, 15*b*, the heat generating resistive member 12 and the lead-out section 13*a*. Or such a process may also be employed as only the heat generating resistive member 12 and the lead-out section 13*a* other than the lead wires 15*a*, 15*b* are printed and the lead wires 15*a*, 15*b* are embedded. The lead-out section 13*a* preferably has a cylindrical shape or plate shape extending at right angles with the longitudinal direction of the ceramic member 11.

The heat generating resistive member 12, the lead-out sections 13*a*, 13*b* and the lead wires 15*a*, 15*b* are press-molded together with the material to form the ceramic member 11, so as to form a compact of powder having the shape of the main body. Then the compact of the ceramic heater housed in a pressuring die made of graphite is put into a firing furnace and is, after removing the binder by calcinations as required, and is fired by hot press process at a predetermined temperature for a predetermined period of time, thereby to obtain a ceramic heater 10.

At this time, the protrusion 16 having round (substantially cylindrical) shape protruding from the circumference 16*ab* provided on the end face is formed at the center of the end face of the ceramic heater 10, while the side face of the lead-out section 13*a* is exposed on the side face of the protrusion 16. The protrusion 16 having substantially cylindrical shape may be formed by grinding the corresponding portion of the ceramic member 11 after firing with a diamond grinder having a cavity of shape complementary to the protrusion 16, or cutting in the stage of forming the compact of the ceramic heater 10. The shape of the protrusion may also be formed by means of a mold in the press molding process of the ceramic heater 10. In this embodiment, the lead-out section 13*a* is formed in such a configuration as preferably cylindrical or plate shape which extends in two directions on a straight line from the center axis of the ceramic member 11. Accordingly, the lead-out section 13*a* is exposed at opposing two points on the circumferential surface of the protrusion 16 when the protrusion 16 is formed in a cylindrical shape.

The terminal of the positive electrode lead-out fixture 14 formed in cup shape (bottomed tube shape) is engaged with the protrusion 16 of the ceramic heater 10, while the lead-out section 13*a* exposed on the side face of the protrusion 16 and the terminal of the positive electrode lead-out fixture 14 are brazed together. Furthermore, the ceramic heater 10 is fitted in the outer tube made of metal 22 made of stainless steel and is brazed, and is then brazed in the housing 25 and calked so as to be fastened thereby completing the glow plug 26.

The ceramic heater 10 of this embodiment is sintered by firing while the positive lead wire 15*a* is disposed at an offset position and, after sintering, forming the protrusion 16 through grinding or other machining process of the end face of the ceramic heater 10 thereby to form a stepped shape. At this time, it is preferable to locate the lead wire 15*a* at a position near the center of the lead-out section 13*a* by disposing the lead wire 15*a* disposed at an offset position before sintering. As the lead wire 15*a* is located at a position near the center of the lead-out section 13*a*, it is made possible to obtain substantially uniform resistance along a path from the circumference of the lead-out section 13*a* to the lead wire 15*a*, thereby to suppress localized heat generation. The lead-out section 13*a* which is drawn out from the lead wire 15*a* is exposed, on both side faces thereof, directly on the side face of the protrusion 16. In this configuration, since the positive lead wire 15*a* and the positive electrode lead-out fixture 14 are connected to each other at a plurality of positions, the connection is established through a larger area for more secure connection. Also because the distal end of the terminal of the positive electrode lead-out fixture 14 is formed in cup shape and is engaged with the protrusion 16 and joined together by brazing, strength of the portion 16 which is brazed is improved.

Second Embodiment

Ceramic Heater

Figure 3A:
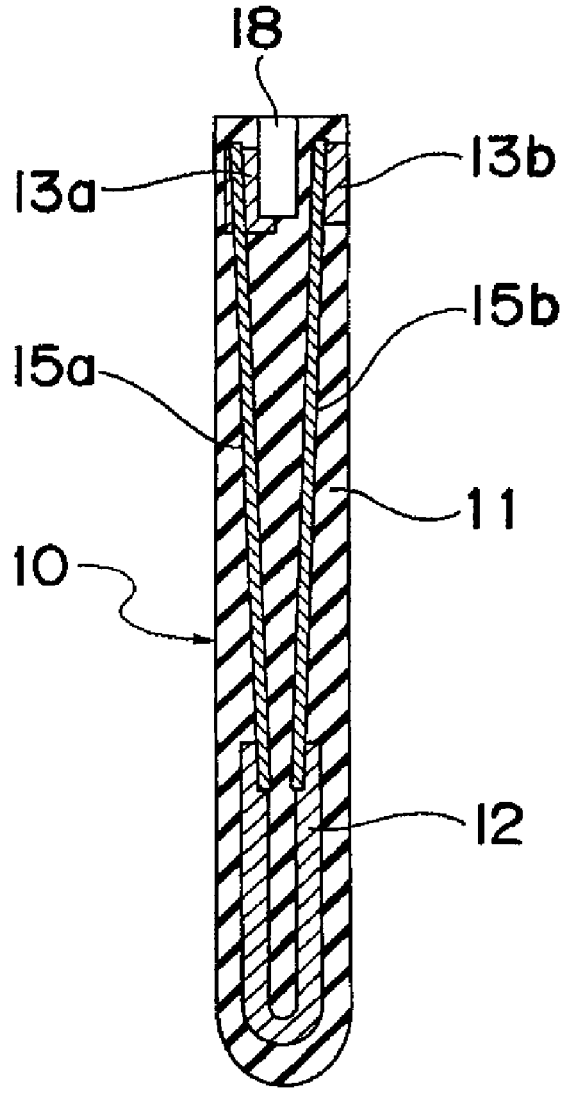
FIG. 3A is a longitudinal sectional view of a ceramic heater according to second embodiment of the present invention.
Figure 3B:
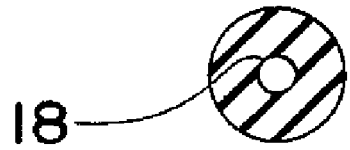
FIG. 3B is a cross sectional view of the ceramic heater shown in FIG. 3A.

FIG. 3A is a longitudinal sectional view of a ceramic heater according to this embodiment, and FIG. 3B shows the end face at the base of the ceramic heater shown in FIG. 3A. The ceramic heater of this embodiment is similar to that of the first embodiment except for the points described below. The ceramic heater 10 shown in FIG. 3A and FIG. 3B comprises the main body 11 formed from electrically insulating ceramics, the heat generating resistive member 12 embedded in the main body 11 at the distal end thereof, the electrode lead-out hole 18 formed in the main body 11 at the base end thereof, a pair of electrode lead-out sections 13*a* and 13*b* formed in the main body 11 at the base end thereof, and a pair of lead wires 15*a* and 15*b* which establish electrical connection between the electrode lead-out sections 13*a* and 13*b* and the heat generating resistive member 12. The electrode lead-out section 13*a* connected to the positive lead wire 15*a* is exposed from the electrode lead-out hole 18, while the electrode lead-out section 13*b* connected to the negative lead wire 15*b* is exposed on the side face of the main body 11.

The main body 11 has a cylindrical shape measuring from 2 to 5 mm in diameter and from 15 to 50 mm in length, and is formed from electrically insulating ceramics which has sufficient electrical insulation property with respect to the heat generating resistive member 12 and the lead wires 15*a*, 15*b* and so on at temperatures from −20 to 1500° C. It is preferable that the electrically insulating ceramics has electrical insulation property 108 times or more with respect to the heat generating resistive member 12. While there is no limitation to the component that constitutes the main body 11, nitride ceramics is preferably used. This is because nitride ceramics has relatively high heat conductivity which makes it possible to efficiently transfer heat from the distal end to the other end of the ceramic heater 10, thereby decreasing the temperature difference between the distal end and the base end of the ceramic heater 10.

Embedded in the main body 11 at the distal end thereof is the heat generating resistive member 12 which is formed in U-shaped longitudinal section from electrically conductive ceramics of rod shape or sheet shape. The heat generating resistive member 12 is formed by firing a paste which contains an electrically conductive component and an insulating component and a ceramic green compact which would becomes the main body 11 together.

The electrically conductive component is preferably at least one kind of silicate, carbide or nitride of at least one element selected from among W, Ta, Nb, Ti, Mo, Zr, Hf, V, Cr and so on. The insulating component is preferably silicon nitride, aluminum nitride, aluminum oxide, mullite or the like.

The heat generating resistive member 12 may be formed not only by embedding the whole thereof as shown in FIG. 3A but also by exposing a part thereof from the main body 11 (not shown). The heat generating resistive member 12 may be, besides the electrically conductive ceramics, formed in a coil shape from a metal having high melting point such as tungsten, molybdenum or rhenium.

Formed on the base end side of the main body 11 running from the base end face along the longitudinal direction is the electrode lead-out hole 18. The electrode lead-out hole 18 has cross section of substantially circular shape measuring from about 0.2 to 0.5 mm in diameter and about 3 to 15 mm in length. The phrase "substantially circular shape" means that the ratio of minor axis length B to major axis length A satisfies a relation of $0.8 \leqq B/A \leqq 1$. In the case of a ceramic heater which is required to have the capability of quick heating and high durability at high temperatures, it is fired by means of hot press at a high firing temperature under a high pressure, in order to achieve high strength of ceramics of the main body 11 and high temperature resistance of the heat generating resistive member 12. Since the hot press firing process is carried out by applying high uniaxial pressure, the cross section of the heat generating resistive member 18 is deformed into oval shape, and it is highly probable that the ratio of minor axis length B to major axis length A becomes $B/A<0.8$. The present inventors found that such a shape causes crack to be generated around the electrode lead-out hole 18 due to residual stress caused by firing, thus resulting in significant decrease in high temperature reliability of the electrode section. According to the present invention, the ratio of minor axis length B to major axis length A is controlled within the range of $0.8 \leqq B/A \leqq 1$ by employing a manufacturing method to be described later, and therefore connection between the positive electrode lead-out section 13*a* and the positive electrode lead-out fixture 14 is maintained in stable condition and high reliability of heat resistance can be obtained. The ratio B/A of minor axis length B to major axis length A is more preferably set to 0.85 or higher, and furthermore preferably set to 0.89 or higher.

The positive electrode lead-out section 13*a* is exposed in the electrode lead-out hole 18 on the base end side of the main body 11. The negative electrode lead-out section 13*b* is exposed on the side face of the main body 11. The electrode lead-out sections 13*a*, 13*b* may be preferably formed from a paste of similar composition as that of the heat generating resistive member 12. The lead wires 15*a*, 15*b* may be preferably formed from an electrically conductive material containing tungsten as the main component, but is not limited to this.

This embodiment is characterized by the structure of the positive electrode side of the ceramic heater 10. That is, the ceramic heater 10 having high reliability of heat resistance can be made by forming the electrode lead-out hole 18 around which the positive electrode lead-out section 13*a* is exposed so as to have cross section of substantially circular shape. The inventors of the present application found that the ceramic heater of the prior art where the electrode lead-out hole 18 has oval shape involves such a problem that crack is likely to be generated around the electrode lead-out hole 18 due to residual stress which develops inside. Since the electrode lead-out hole 18 of this embodiment has substantially circular shape, there occurs less residual stress which is distributed throughout the inner circumference of the electrode lead-out hole 18. As a result, cracks can be prevented from being generated around the electrode lead-out hole 18.

(Method of Forming Electrode Lead-Out Hole 18)

Figure 4A:
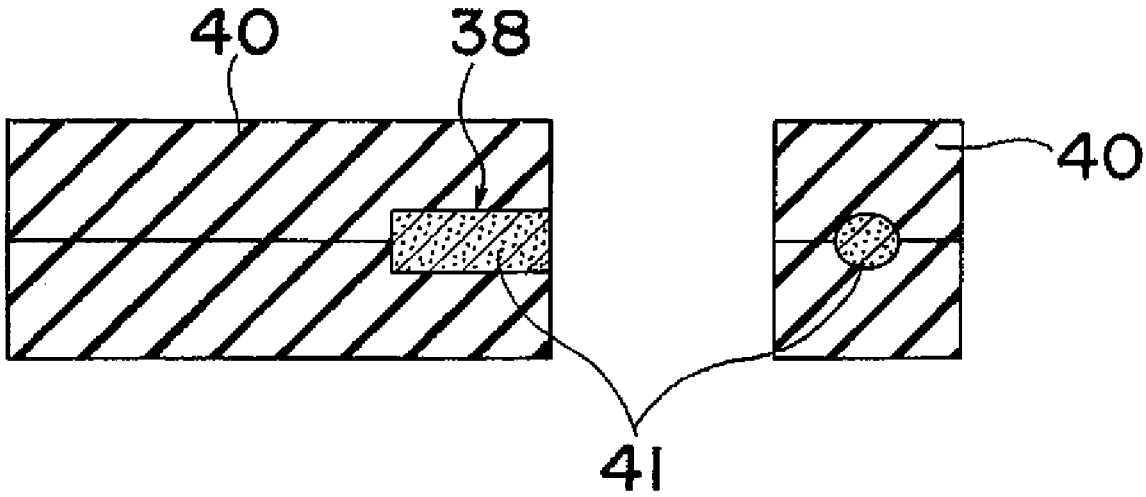
FIG. 4A is a process diagram showing a method of forming the electrode lead-out hole in the second embodiment.
Figure 4B:
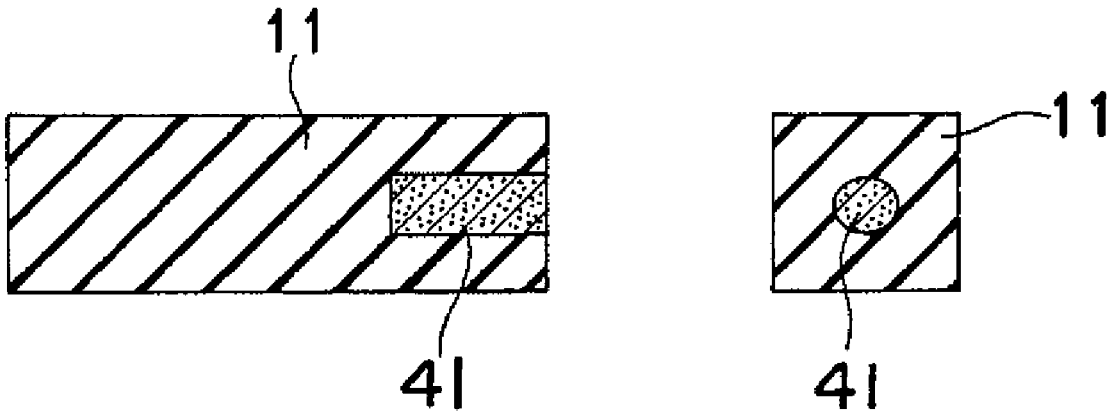
FIG. 4B is a process diagram showing a process subsequent to that shown in FIG. 4A.
Figure 4C:
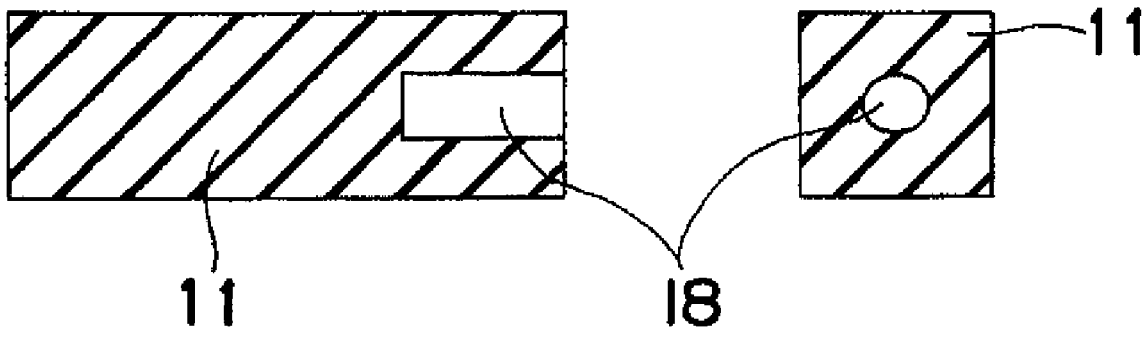
FIG. 4C is a process diagram showing a process subsequent to that shown in FIG. 4B.

The electrode lead-out hole 18 can be formed, for example, as follows. First, a recess 38 which would become the electrode lead-out hole 18 is formed in the interface between two parts of the green compact 40 made of electrically insulating ceramics, as shown in FIG. 4A. The two parts of the ceramic compact 40 are put together with a hole forming member 41 embedded in the recess 38 which forms the electrode lead-out hole 18. After firing the assembly by hot press as shown in FIG. 4B, the hole forming member 41 is removed by either heat treatment or mechanical means such as water jet as shown in FIG. 4C, so as to obtain a ceramic compact having the electrode lead-out hole 18 formed therein. Such a method as described above is capable of forming the electrode lead-out hole 18 in the ceramic member 11 of the ceramic heater 10 in a short period of time at a low cost.

Figure 5A:
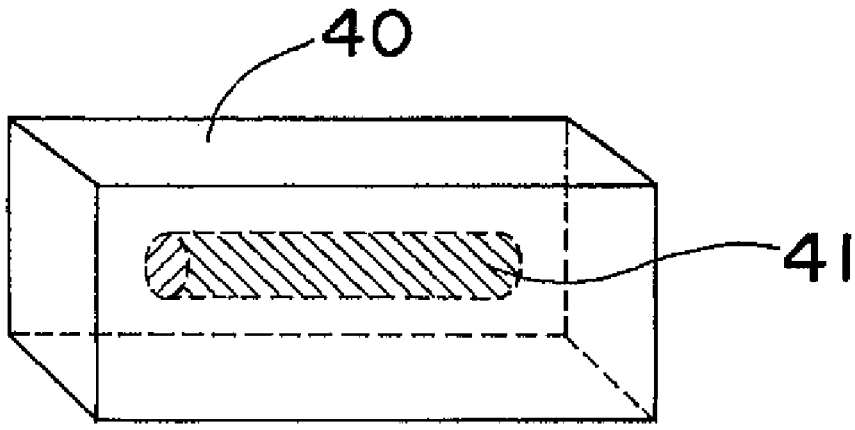
FIG. 5A is a process diagram showing another method of forming the electrode lead-out hole in the second embodiment.
Figure 5B:
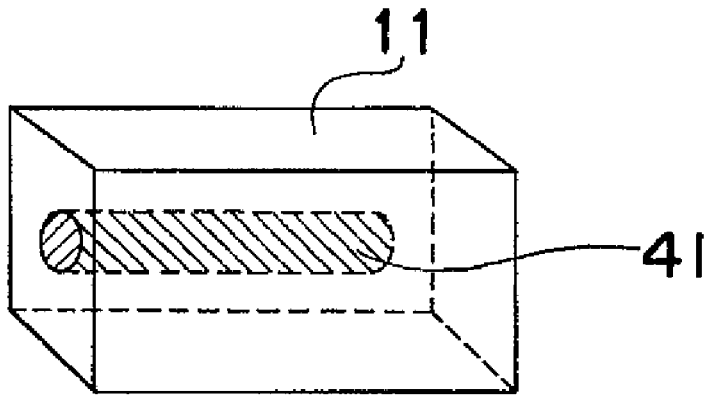
FIG. 5B is a process diagram showing a process subsequent to that shown in FIG. 5A
Figure 5C:
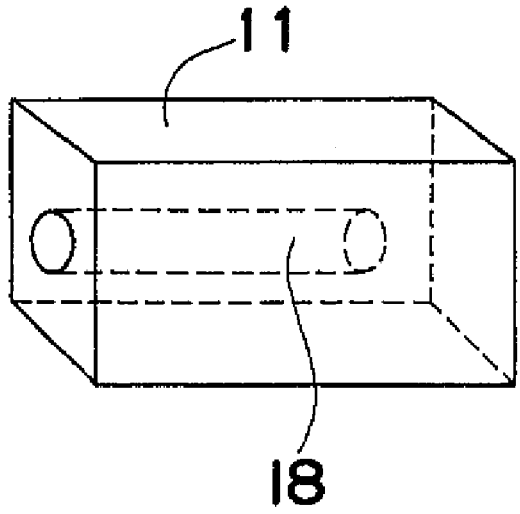
FIG. 5C is a process diagram showing a process subsequent to that shown in FIG. 5B.
Figure 6A:
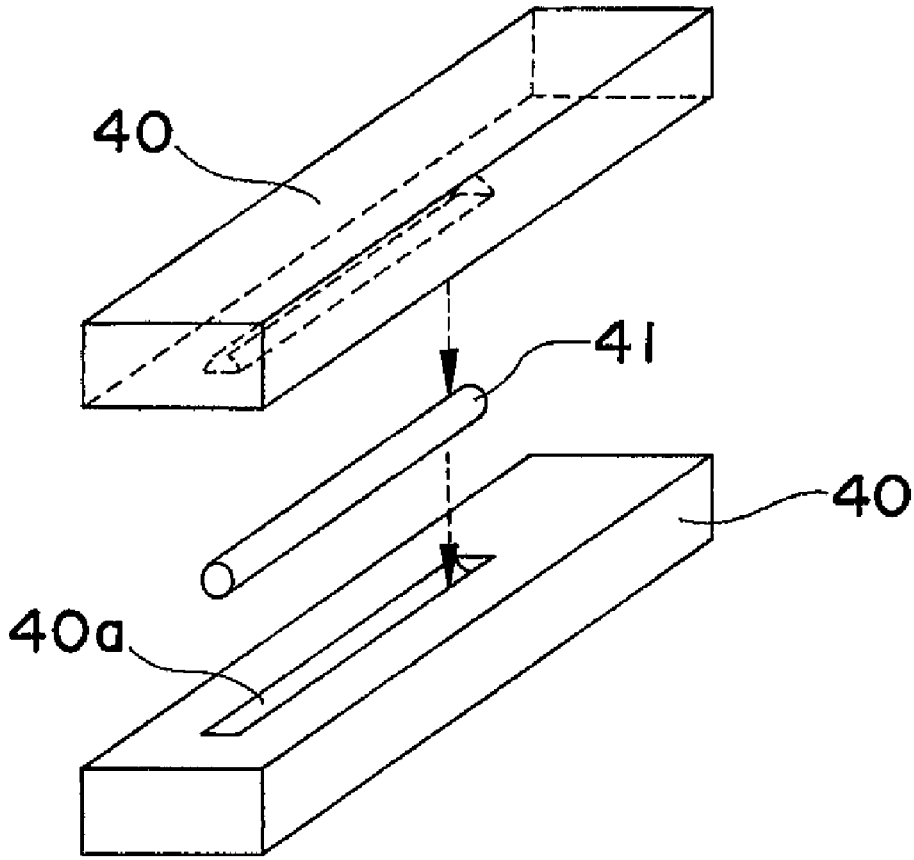
FIG. 6A is a schematic diagram showing a method of embedding the hole forming member in a green compact.
Figure 6B:
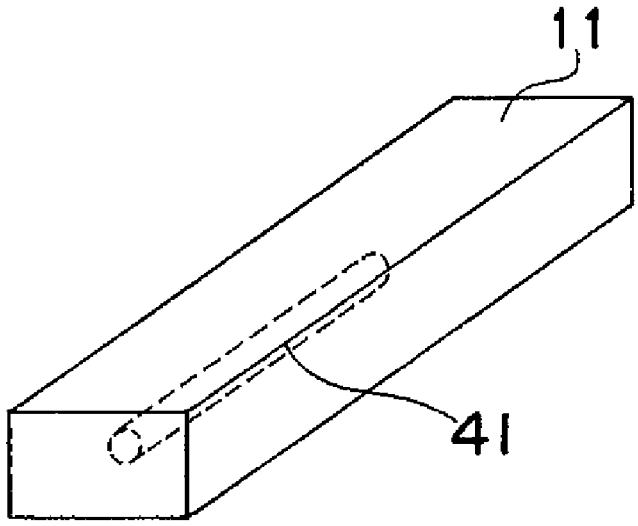
FIG. 6B is a perspective view showing the green compact with the hole forming member embedded therein.

While the compact is fired with part of the hole forming member 41 exposed on the surface of the compact 40 in the example described above, the hole forming member 41 may be embedded completely in the compact 40 when fired. For example, the hole forming member 41 is embedded in the ceramic compact 40 as shown in FIG. 5A. Then the compact 40 is fired in an inert gas atmosphere such as $N_2$ gas or He gas or in a reducing atmosphere, so as to form the sintered body 11 with the hole forming member 41 remaining inside. Use of hot press firing or pressured firing in an inert gas enables it to sinter the compact 40 without causing cracks by taking advantage of the density which increases due to grain boundary sliding in the sintered material 11. Then a part of the hole forming member 41 is exposed as shown in FIG. 5B. Part of the hole forming member 41 can be exposed by such means as grinding, cutting, laser machining, sand blast, ultrasonic machining or water jet machining. For example, the hole forming member 41 may be exposed by grinding with a surface grinding machine. Then the hole forming member 41 is removed as shown in FIG. 5C.

The ceramic compact 40 can be formed as follows, in case a mechanical press is employed. First, cavity of a die is half-filled with the stock material powder which is pressed for preliminary molding. The hole forming member 41 is placed on the preliminary molding, and additional stock material powder is placed thereon, with the entire body being pressed again, thereby to obtain the ceramic compact 40.

In case hot press firing is employed, the ceramic compact 40 is divided into two or more parts and the recess 40*a* is formed in the interface thereof where the hole forming member 41 is to be placed. Then the hole forming member 41 is placed in the recess 40*a* and the parts of the compact 40 are put together.

The compact 40 may be formed not only by using the mold but also by stacking ceramic green sheets. The compact may also be formed by using an injection molding machine or the like, with the hole forming member 41 being embedded in the compact during the process.

For the hole forming member 41, for example, a carbon pin is preferably used. The carbon pin maintains its hardness at high temperatures, and is turned into carbon dioxide and water by oxidization under ideal conditions. Accordingly, the use of carbon pin as the hole forming member 41 solves the problems of the prior art related to the removal by acid dissolution of the embedded metal having high melting point such as Mo, such as the crack developing around the electrode lead-out hole 18, process time and disposal of waste liquid. The carbon pin used as the hole forming member 41 may have any shape which suits the shape of the desired hole such as cylinder or prism, and preferably has density of 1.5 g/cm$^3$ or higher. When density of the carbon pin is less than 1.5 g/cm$^3$, cross section of the ceramic member cannot be prevented from being deformed during hot press firing, and the hole may not be formed in the desired shape. In case firing is carried out under a pressure of 30 MPa or higher, the density is preferably 1.6 g/cm$^3$ or higher in order to avoid deformation during firing.

Figure 7:
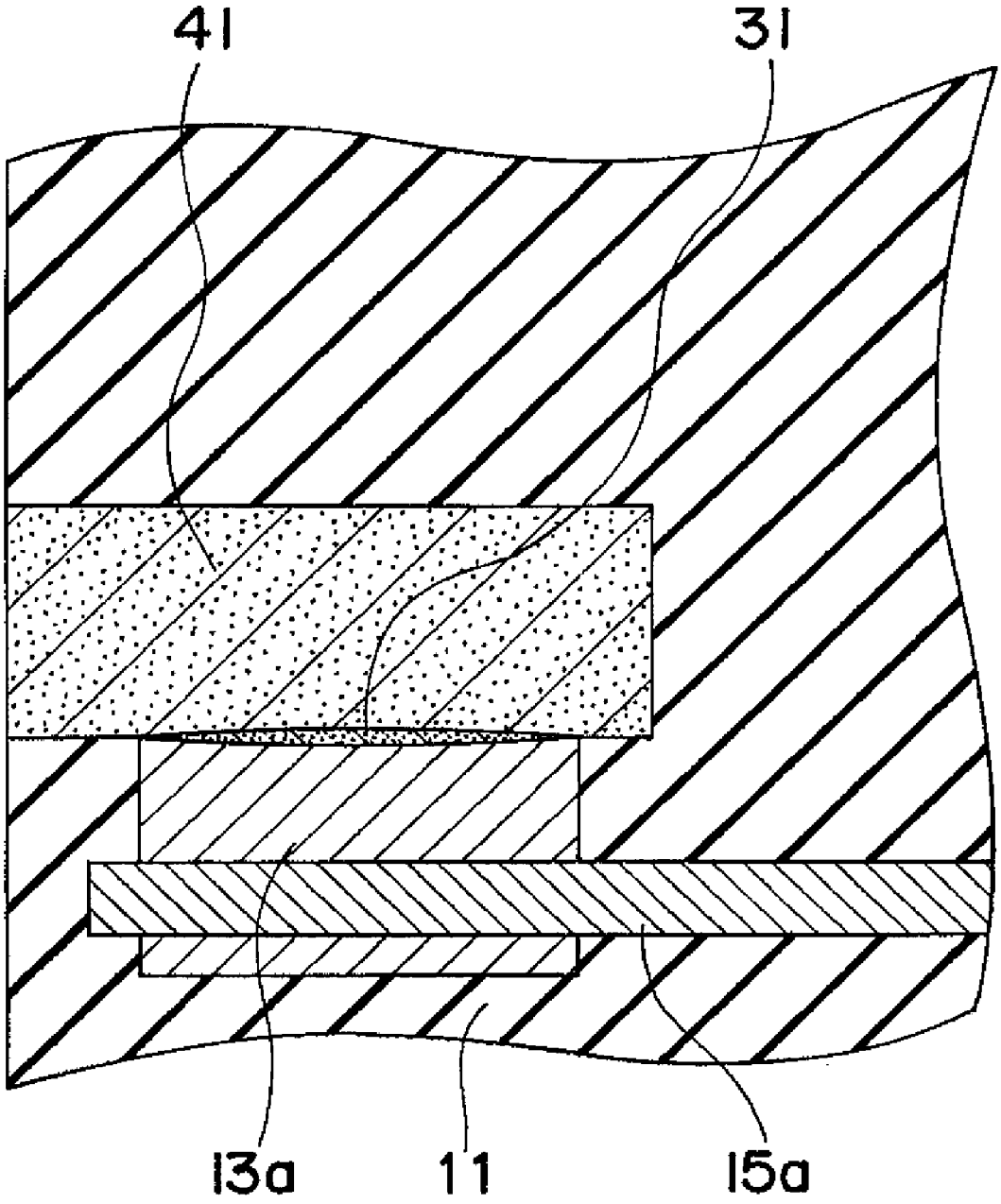
FIG. 7 is a partially enlarged sectional view of a portion in the vicinity of the electrode lead-out hole of the ceramic heater according to the second embodiment.

In order to make the positive electrode lead-out section 13*a* resistant to oxidization, it is preferable that the reaction layer 31 is formed on the surface of the electrode lead-out section 13*a* which is in contact with the hole forming member 41 as shown in FIG. 7. This makes it possible to prevent oxidization of the positive electrode lead-out section 13*a* and to secure connection with positive electrode lead-out fixture which is inserted after when the hole forming member 41 is removed by firing. After the hole forming member 41 has been removed, it is highly likely that the reaction layer 31 remains on the surface of the electrode lead-out section 13*a*.

With silicon nitride ceramics used as the ceramic main body 11 and the carbon pin used as the hole forming member 41, for example, the carbon pin 41 is embedded at substantially the center of the cross section of the electrode lead-out hole 18 of the main body 11, and the assembly is fired at a temperature from about 1650 to 1800° C. in reducing atmosphere. This results in the formation of the reaction layer 31 made of SiC on the surface of the positive electrode lead-out section 13*a*. Oxidization resistance of the SiC layer prevents the electrode lead-out section 13*a* from being oxidized when removing the carbon pin 41 serving as the hole forming member by firing at a temperature from about 800 to 1000° C. in oxidizing atmosphere.

The hole forming member 41 can be easily removed by firing at a temperature of about 1000° C. in oxidizing atmosphere for a period of 30 minutes to 1 hour with a part of the hole forming member exposed from the ceramic member 11 at the base end side thereof. In case the carbon pin is used as the hole forming member 41, for example, exposure of the carbon pin 41 to the oxidizing atmosphere causes the carbon pin to be vaporized in the form of carbon dioxide, thereby removing the carbon pin embedded in the sintered body 11. This enables it to form the hole without machining operation.

The heat treatment is preferably carried out at a temperature of about 800° C. or higher while it depends on the kind of ceramic material, and the duration of the heat treatment depends on the size of the carbon pin 41, while the carbon pin 41 measuring 1 mm in diameter and 5 mm in length, for example, can be removed by holding a temperature of 1000° C. for about 3 hours. Ash of the burned carbon may be removed as required by cleaning the inside of the hole by sand blast, water jet or the like.

The hole forming member 41 may also be removed mechanically by means of water jet or the like. In case the hole forming member 41 is removed mechanically by means of water jet or the like, the carbon pin used as the hole forming member 41 may be coated with BN (boron nitride) on the surface before being embedded and fired, followed by the formation of the hole. When boron nitride coating is applied, mechanical removal by means of water jet or the like can be done efficiently since the reaction layer 31 is not formed on the surface of the electrode lead-out section 13*a*.

(Glow Plug)

Figure 8:
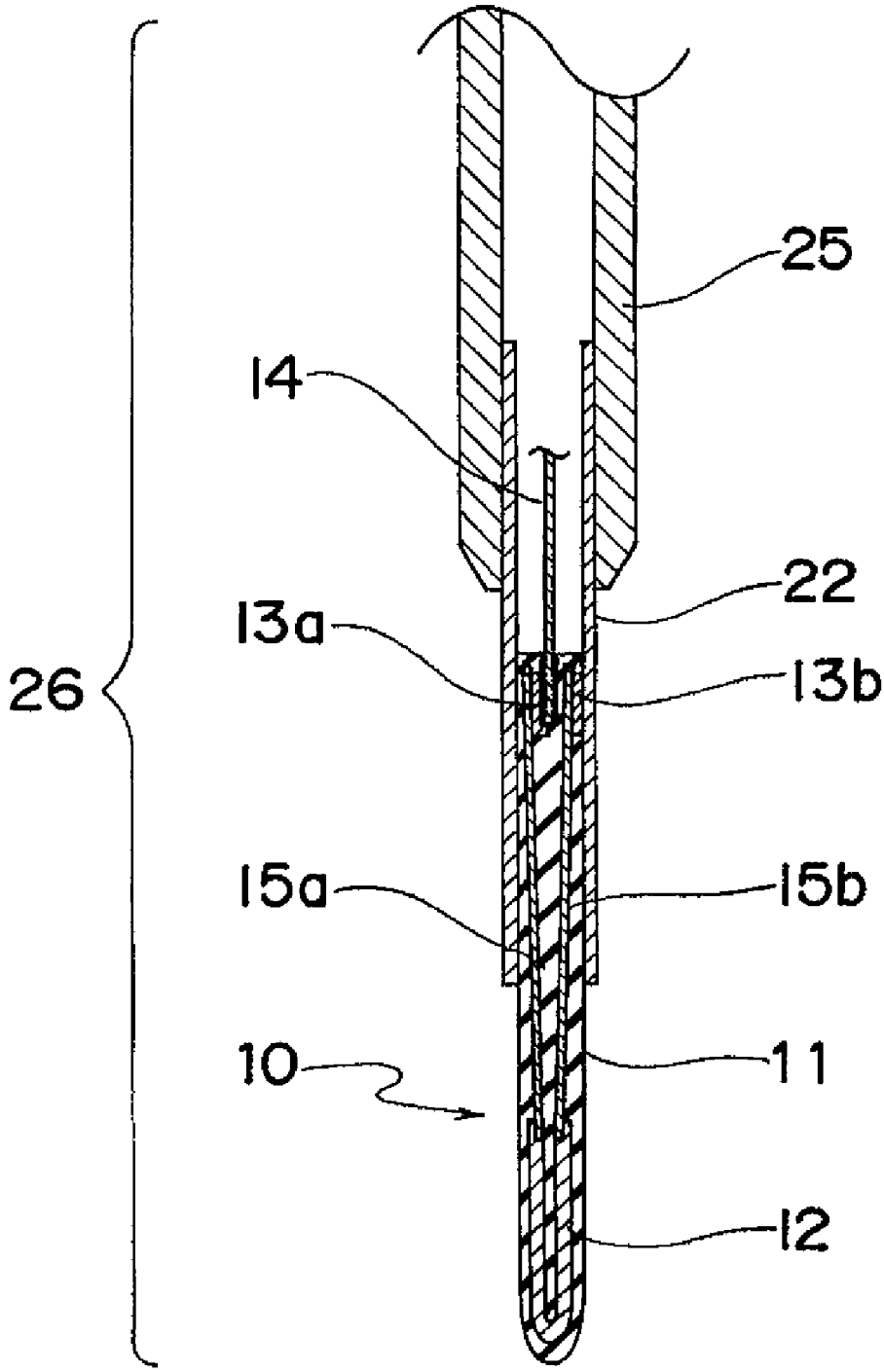
FIG. 8 is a sectional view of a glow plug having the ceramic heater shown in FIG. 3A.

FIG. 8 shows an example of glow plug that employs the ceramic heater 10 of this embodiment.

This glow plug is similar to the glow plug of the first embodiment, except for the following differences. The ceramic heater type glow plug has a multi-stage structure comprising the ceramic heater 10, the outer tube made of metal 22 which covers the base end side of the main body 11 of the ceramic heater 10 at the distal end side thereof, and the housing 25 which covers the base end side of the outer tube made of metal 22 at the distal end side thereof, similarly to the first embodiment.

Figure 9:
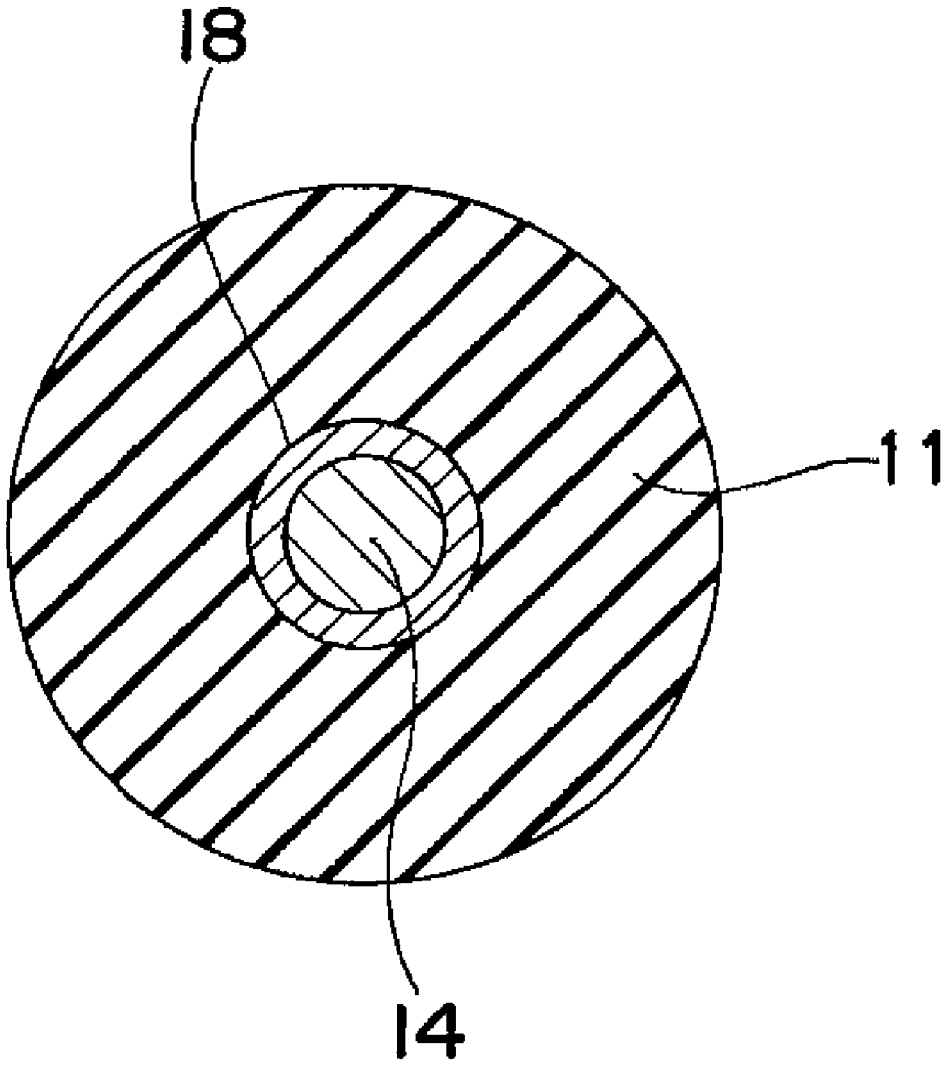
FIG. 9 is a diagram showing the rear end face of the ceramic heater according to the second embodiment.

The positive electrode lead-out fixture 14 is inserted in the electrode lead-out hole 18 of the ceramic heater 10, and is electrically connected to the lead-out section 13*a* which is exposed around the electrode lead-out hole 18. The electrode lead-out hole 18 is baked in vacuum so as to form a metallized layer. The positive electrode lead-out fixture 14 coated with a paste consisting of Au—Cu, Au—Ni, Ag—Cu as the main component and containing an active metal is inserted into the electrode lead-out hole 18, and is bonded by brazing. In case the reaction layer 31 is formed around the electrode lead-out hole 18 (on the surface of the electrode lead-out section 13*a*), the reaction layer 31 may be removed mechanically by means such as grinding or water jet so as to expose the electrode lead-out section 13*a* which is then brazed. When the positive electrode lead-out fixture 14 is brazed onto the electrode lead-out hole 18, it is preferable to secure the positive electrode lead-out fixture 14 at the center of the electrode lead-out hole 18 as shown in FIG. 9. This makes it possible to prevent cracks from being generated by stress concentration due to unevenness of brazing material.

(Method for Manufacturing Ceramic Heater and Glow Plug)

An example of a method for manufacturing a ceramic glow plug will now be described. A main component of the electrically insulating ceramics which forms the main body 11 and sintering additive are mixed to prepare the stock material powder. Then the stock material powder is molded into two parts of compact, which would become the main body 11 when put together, by means of a press. On the other hand, a paste for the heat generating resistive member is prepared and is printed in the shape of the conductor of the electrode lead-out sections 13*a*, 13*b* and the heat generating resistive member 12 by screen printing on the mating surface of at least one part of the ceramic compact. Then lead wires are placed on the mating surface of the part of the ceramic compact so as to electrically connect the heat generating resistive member 12 and the electrode lead-out sections 13*a*, 13*b*, and the carbon pin that would become the hole forming member 41 of the electrode lead-out hole 18 is placed. Then with these members interposed therebetween, the two parts of the compact are put together and subjected to hot press firing at a temperature from about 1650 to 1800° C. in an inert gas atmosphere or reducing atmosphere, thereby to obtain the main body 11 and the heat generating resistive member 12 in a single firing process (in this stage, end face of the carbon pin is covered by the main body 11 spreads over and is not exposed). Then the base end of the main body 11 is cut or otherwise machined, so as to expose the end face of the carbon pin which serves as the hole forming member 41, which is then removed by firing at a temperature from about 800 to 1000° C. in an oxidizing atmosphere, thereby to form the electrode lead-out hole 18 where the positive electrode lead-out section 13*a* is exposed. Then the ceramic compact is machined to turn from prism shape into substantially cylindrical shape and the negative electrode lead-out section 13*b* is exposed. A paste containing Ag—Cu is applied to the surfaces of the positive electrode lead-out section 13*a* and the negative electrode lead-out section 13*b*, and is fired in vacuum so as to form a metallized layer. Then the base end of the ceramic heater 10 is inserted into the outer tube made of metal 22, and the positive electrode lead-out fixture 14 is inserted into the electrode lead-out hole 18 of the ceramic heater, with the assembly being brazed so as to obtain the ceramic glow plug.

Example 1

The ceramic heater 10 shown in FIG. 1A was made by the method described below.

2 to 10% by mole of an oxide of a rare earth element is added as the sintering additive to 90 to 92% by mole of silicon nitride which is the main component of the electrically insulating ceramics that constitutes the ceramic member 11. 0.2 to 2.0% by weight of aluminum oxide and 1 to 5% by weight of silicon oxide were mixed with silicon nitride and oxide of rare earth element, so as to prepare the stock material powder.

The stock material powder is press-molded to obtain a compact. A paste for the heat generating member is prepared by adding a proper organic solvent and a solvent to tungsten and mixing, and the paste is applied by screen printing onto the top surface of the compact in the form of the conductors of the heat generating resistive member 12 and the lead-out sections 13*a*, 13*b*.

Electrically conductive material containing tungsten as the main component is interposed as the lead wires 15*a*, 15*b* between the heat generating resistive member 12 and the lead-out sections 13*a*, 13*b*, which are put together in close contact with each other. The assembly was subjected to hot press firing at a temperature from about 1650 to 1800° C. thereby to obtain the ceramic main body 11 and the heat generating resistive member 12 at the same time.

Then the round protrusion 16 protruding from the circumference 16*ab* was formed by grinding at the center of the end face of the ceramic heater 10 on the base side. At the same time, Then the terminal of the positive electrode lead-out fixture 14 formed in cup shape was engaged with the protrusion 16 formed on the end face of the ceramic heater 10, and the positive electrode lead-out fixture 14 and the lead-out section 13*a* were bonded together by brazing.

The lead-out section 13*a* was exposed at 4 positions, 2 positions and 1 position. In case the lead-out section 13*a* was exposed at 4 positions or 2 positions, two types were made: one with the lead-out section 13*a* exposed at opposing positions, and one with the lead-out section 13*a* exposed on one side only.

When the lead-out section 13*a* was exposed at opposing positions, the following configuration was employed. In case the lead-out section 13*a* was exposed at 4 positions, for example, the positions of exposure were disposed at equal intervals of 90 degrees along the circumference of the protrusion 16. In case the lead-out section 13*a* was exposed at 2 positions, the positions of exposure were disposed at intervals of 180 degrees along the circumference of the protrusion 16. Configuration of adjacent positions where the lead-out section 13*a* is exposed are located 90 degrees apart will be regarded as disposed at opposing positions.

In case the lead-out section 13*a* was exposed on one side only, the positions where the lead-out section 13*a* was exposed were all located within a region of 30 degrees along the circumference of the protrusion 16.

Samples of the ceramic heater 10 were made so as to have different values of the ratio A/B of outer diameter A of the protrusion 16 to outer diameter B of the ceramic member 11. Also samples of the ceramic heater 10 having different cross sectional areas of the lead-out section 13*a* were made.

Each of the samples was subjected to durability test under current in which such a voltage was applied to the heat generating resistive member 12 as the Joule heat generated by the heat generating resistive member 12 caused saturation temperature of the ceramic heater of 1400° C. A cycle of durability test under current consisting of 5 minutes of voltage application and 3 minutes of forced cooling without voltage applied was repeated 10,000 times, and the change in temperature after the test was investigated. The forced cooling was carried out by blowing compressed air of room temperature to the portion of the ceramic heater where heat was generated at the highest rate.

The results of the test are shown in Table 1.

TABLE 1

| No. | Number of lead-out sections | Arrangement of lead-out sections | Diameter ratio | Cross sectional area of lead-out section ($\mu m^2$) × $10^5$ | Result of durability test (° C.) | Judgment |
|---|---|---|---|---|---|---|
| 1 | 4 | Opposing | 0.56 | 0.8 | −26 | B |
| 2 | | arrangement | 0.4 | 1.0 | −22 | A |
| 3 | | | 0.4 | 6.8 | −17 | A |
| 4 | | | 0.46 | 6.0 | −12 | A |
| 5 | | | 0.6 | 6.0 | −7 | A |
| 6 | | | 0.82 | 6.0 | −10 | A |

TABLE 1-continued

| No. | Number of lead-out sections | Arrangement of lead-out sections | Diameter ratio | Cross sectional area of lead-out section ($\mu m^2$) × $10^5$ | Result of durability test (° C.) | Judgment |
|---|---|---|---|---|---|---|
| 7 | | | 0.88 | 1.0 | −14 | A |
| 8 | | | 0.88 | 6.8 | −21 | A |
| 9 | | | 0.56 | 7.5 | −27 | B |
| 10 | 2 | Opposing arrangement | 0.38 | 0.8 | −89 | C |
| 11 | | | | 2.1 | −42 | B |
| 12 | | | | 7.5 | −78 | C |
| 13 | | | 0.56 | 0.8 | −39 | B |
| 14 | | | 0.4 | 1.0 | −25 | A |
| 15 | | | 0.4 | 6.8 | −24 | A |
| 16 | | | 0.46 | 6.0 | −19 | A |
| 17 | | | 0.6 | 6.0 | −14 | A |
| 18 | | | 0.82 | 6.0 | −17 | A |
| 19 | | | 0.88 | 1.0 | −21 | A |
| 20 | | | 0.88 | 6.8 | −25 | A |
| 21 | | | 0.56 | 7.5 | −31 | B |
| 22 | | | 0.92 | 0.8 | −59 | C |
| 23 | | | | 2.1 | −44 | B |
| 24 | | | | 7.5 | −63 | C |
| 25 | | One side | 0.38 | 0.8 | −72 | C |
| 26 | | | | 2.1 | −64 | C |
| 27 | | | | 7.5 | −74 | C |
| 28 | | | 0.56 | 0.8 | −83 | C |
| 29 | | | | 2.1 | −47 | C |
| 30 | | | | 7.5 | −79 | C |
| 31 | | | 0.92 | 0.8 | −81 | C |
| 32 | | | | 2.1 | −73 | C |
| 33 | | | | 7.5 | −91 | C |
| *34 | 1 | One side | 0.38 | 0.8 | −240 | D |
| *35 | | | | 2.1 | −150 | D |
| *36 | | | | 7.5 | −450 | D, Crack in lead-out section |
| *37 | | | 0.56 | 0.8 | −180 | D |
| *38 | | | | 2.1 | −130 | D |
| *39 | | | | 7.5 | −320 | D, Crack in lead-out section |
| *40 | | | 0.92 | 0.8 | −210 | D, Crack in protrusion |
| *41 | | | | 2.1 | −160 | D, Crack in protrusion |
| *42 | | | | 7.5 | −180 | D, Crack in protrusion |

Sample marked with * is out of the scope of the invention.

Diameter ratio in Table 1 means the ratio A/B of outer diameter A of the protrusion to outer diameter B of the ceramic member. Change in temperature after the durability test is the temperature attained when such a voltage was applied, that would cause saturation temperature of the ceramic heater of 1400° C. before durability test, after the durability test under current of 10,000 cycles minus 1400° C. Samples which showed temperature change within −25° C. were evaluated as A (very good), samples which showed temperature change within −45° C. were evaluated as B (good), samples which showed temperature change within −100° C. were evaluated as C (tolerable) and samples which showed temperature change exceeding −100° C. were evaluated as D (unacceptable).

The results shown in Table 1 indicate that acceptable result can be obtained from samples Nos. 1 through 33 in terms of the temperature change after 10,000 cycles of test. Samples Nos. 34 through 42 did not show satisfactory results in the temperature change after 10,000 cycles of test.

Samples Nos. 2 through 8 and Nos. 14 through 20 had plurality of lead-out sections, where lead-out section was disposed in opposing direction, diameter ratio satisfied a relation of $0.4 \leqq A/B \leqq 0.88$, and the lead-out section had cross sectional area in a range from $1\times10^5$ through $6.8\times10^5$ $\mu m^2$. These samples showed very good results of temperature change within −25° C. after 10,000 cycles of test.

Samples No. 36 and Nos. 39 through 42 which were comparative examples showed crack in the lead-out section 13*a* or the protrusion 16.

Ceramic heaters 10 made under the conditions of samples Nos. 1 through 33 which showed good results in this Example were provided with the outer tube made of metal 22 and the housing 25 that were brazed and caulked, thereby making the glow plugs 26. Thermal cycle test was conducted by applying such a voltage as the Joule heat generated by the heat generating resistive member caused saturation temperature at the distal end of the glow plug of 1400° C., each cycle consisting of 5 minutes of voltage application and 3 minutes of forced cooling by blowing compressed air of room temperature to the portion of the ceramic heater where heat was generated at the highest rate without voltage applied, and the sample was subjected to 10,000 cycles. The samples showed very good results of temperature change within −25° C. after 10,000 cycles of test. No damage was found in any point including the contact point between the outer tube made of metal 22 and the ceramic member 11, thus proving excellent thermal shock resistance of the glow plug.

Example 2

The ceramic heaters 10 shown in FIG. 3A and FIG. 3B were made by the method described below. 2 to 10% by mole of an oxide of a rare earth element was added as the sintering additive to 90 to 92% by mole of silicon nitride which was used the main component of the ceramic main body 11. 0.2 to 2.0% by weight of aluminum oxide and 1 to 5% by weight of silicon oxide were mixed with silicon nitride and oxide of rare earth element, so as to prepare the stock material powder.

The stock material powder was press-molded to obtain two parts of green ceramic compact that would form the shape of the main body 11 when put together. A paste for the heat generating member was prepared by adding a proper organic solvent and a solvent to a material which contained tungsten carbide as the main component and mixing, and the paste was applied by screen printing onto at least one of the mating surfaces of the ceramic compact in the configuration of the conductors of the heat generating resistive member 12 and the lead-out sections 13*a*, 13*b*. The lead wires 15*a*, 15*b* were placed between the mating surfaces of the ceramic compact so as to connect the heat generating resistive member 12 and the lead-out sections 13*a*, 13*b*, while placing the carbon pin serving as the hole forming member 41 of the electrode lead-out hole 18 so as to be embedded in the main body 11. The two parts of the green ceramic compact were put together in close contact with each other while interposing these members therebetween. The assembly was subjected to hot press firing at a temperature from about 1650 to 1800° C. in an inert gas atmosphere or reducing atmosphere thereby to obtain the ceramic main body 11 and the heat generating resistive member 12 at the same time.

Then the end face of the carbon pin serving as the hole forming member 41 was exposed, which was then removed by firing at a temperature from about 800 to 1000° C. in an oxidizing atmosphere, thereby to form the electrode lead-out hole 18 where the positive electrode lead-out section 13*a* was exposed. Then the ceramic main body 11 was machined to turn from prism shape into substantially cylindrical shape and the negative electrode lead-out section 13*b* was exposed. A paste containing Ag—Cu was applied to the surfaces of the lead-out section 13*a* and the lead-out section 13*b*, and was fired in vacuum so as to form metallized layer, thus providing Ni plating layer. Then the ceramic heater 10 was inserted into the outer tube made of metal 22, and the positive electrode lead-out fixture 14 was inserted into the electrode lead-out hole 18, which were then brazed.

The cross-section of the electrode lead-out hole is approximately circular, of which longer diameter is referred to as "A" and shorter diameter is referred to as "B". The ratio B/A was varied. In the same way as in Example 1, temperature change was measured after the 10,000-cycle durability test under current.

TABLE 2

| No. | B/A A: Major axis length B: Minor axis length | Hole forming member | Durability test result Temperature change (° C.) | Judgment A: within −25° C. B: within −45° C. C: within −100° C. D: exceeding −100° C. | Presence of crack at electrode lead-out section |
|---|---|---|---|---|---|
| 1 | 1 | Carbon | −7 | A | No |
| 2 | 0.98 | Carbon | −15 | A | No |
| 3 | 0.92 | Carbon | −10 | A | No |
| 4 | 0.90 | Carbon | −23 | A | No |
| 5 | 0.89 | Carbon | −18 | A | No |
| 6 | 0.86 | Carbon | −28 | B | No |
| 7 | 0.85 | Carbon | −36 | B | No |
| 8 | 0.82 | Mo | −68 | C | No |
| 9 | 0.81 | Mo | −88 | C | No |
| 10 | 0.80 | Mo | −92 | C | No |
| 11 | 0.78 | Mo | −110 | D | Present |
| 12 | 0.75 | Mo | −120 | D | Present |
| 13 | 0.72 | Mo | −119 | D | Present |
| 14 | 0.7 | Mo | −118 | D | Present |
| 15 | 0.68 | Mo | −117 | D | Present |

The results shown in Table 2 indicate that acceptable result can be obtained from samples Nos. 1 through 10 in terms of the temperature change after 10,000 cycles of test. Samples Nos. 11 through 15 did not show good results in terms of the temperature change after 10,000 cycles of test.

Samples Nos. 1 through 7 showed less deformation of the cross section of the hole with very small residual stress around the hole, because the carbon pin having density of 1.5 g/cm$^3$ or higher was used as the hole forming member 41 to form the electrode lead-out hole. As a result, good results were obtained as junction between the electrodes was very stable and the temperature change after the durability test was very small.

However, among the samples having the electrode lead-out hole 18 with the ratio of minor axis length B to major axis length A controlled within a range of $0.8 \leqq B/A \leqq 1$, samples Nos. 8 through 10 showed temperature change after 10,000 cycles of test that was within the tolerance only with narrow margin, since Mo was used as the hole forming member 41 and the ratio B/A of minor axis length B to major axis length A was near 0.8.

Samples Nos. 11 through 15, where the ratio B/A of minor axis length B to major axis length A was less than 0.8, showed temperature change exceeding −100° C. after the durability test. Cracks were observed around the electrode lead-out hole in samples Nos. 11 through 15, supposedly because the junction at the electrode lead-out section deteriorated due to the thermal cycles of the durability test, thus resulting in increased resistance which caused the temperature change exceeding −100° C.

Ceramic heaters 11 made under the conditions of samples Nos. 1 through 5 which showed good results in this Example were provided with the outer tube made of metal 22 and the housing 25 which were brazed together and caulked, thereby making the glow plugs 26. Thermal cycle test was conducted by applying such a voltage as the Joule heat generated by the heat generating resistive member caused saturation temperature at the distal end of the glow plug of 1400° C., each heat cycle consisting of 5 minutes of voltage application and 3 minutes of forced cooling by blowing compressed air of room temperature to the portion of the ceramic heater where heat was generated at the highest rate without voltage applied, and the sample was subjected to 10,000 cycles. The samples showed very good results of temperature change within −25° C. after 10,000 cycles of test. No damage was found in any point including the electrode lead-out hole 18 where the positive electrode lead-out section 13*a* and the positive electrode lead-out fixture 14 were brazed with each other, thus proving excellent thermal shock resistance of the glow plug.

REFERENCE EXAMPLE 1

2 to 10% by mole of an oxide of a rate earth element was added as the sintering additive to 90 to 92% by mole of silicon nitride which was used as the main component. 0.2 to 2.0% by weight of aluminum oxide and 1 to 5% by weight of silicon oxide against total of the silicon nitride and the oxide of a rare earth element were mixed with oxide of rare earth element, so as to prepare the stock material powder. The powder was press-molded so as to form the green compact 40 made of silicon nitride in plate shape.

The green compact 40 had, on one side thereof, a groove 40*a* having cross section of semi-circular shape, and the carbon pin 41 having length of 10 mm was placed in the groove 40*a*. This was put together with another green compact 40 with similar construction thus making a set which was subjected to hot press firing at a temperature from about 1650 to 1800° C., thereby to obtain the sintered body 11. Carbon pins 41 of cylindrical shape measuring 0.5 mm, 1.0 mm and 2.0 mm in diameter and having density of 1.4 g/cm$^3$, 1.5 g/cm$^3$ and 1.6 g/cm$^3$ were used.

The sintered body 11 thus obtained was ground with a surface grinding machine so that one end of the carbon pin 41 was exposed on the surface of the sintered body 11. The sintered body 11 was then subjected to heat treatment 1000° C. in an oxidizing furnace so as to remove the carbon pin 41. Condition of the hole in each sample was checked, with the results shown in Table 3.

TABLE 3

| Sample No. | Carbon pin diameter D mm | Carbon pin density d g/cm$^3$ | Condition of hole Good: B Not good: D | Remark |
|---|---|---|---|---|
| 1* | 0.5 | 1.4 | D | Deformation |
| 2 | 0.5 | 1.5 | B | |
| 3 | 0.5 | 1.6 | B | |
| 4* | 1 | 1.4 | D | Deformation + crack |
| 5 | 1 | 1.5 | B | |
| 6 | 1 | 1.6 | B | |
| 7* | 2 | 1.4 | D | Deformation + crack |
| 8 | 2 | 1.5 | B | |
| 9 | 2 | 1.6 | B | |

Figure 10A:
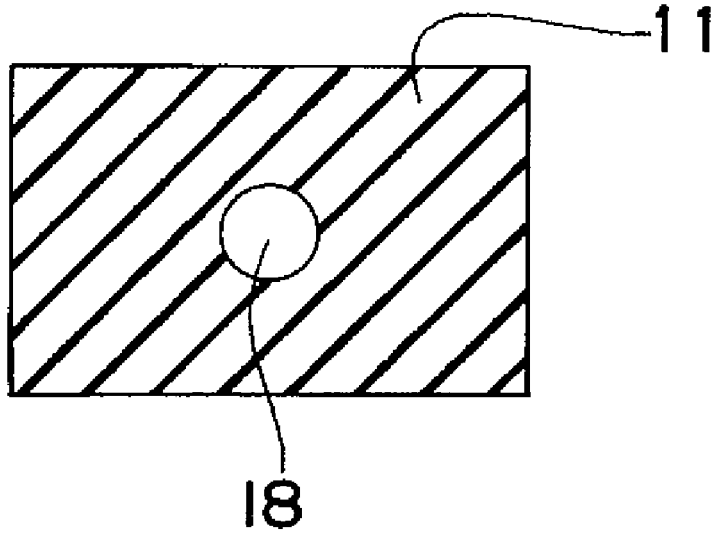
FIG. 10A is a schematic diagram showing the electrode lead-out hole formed in Reference Example 1.
Figure 10B:
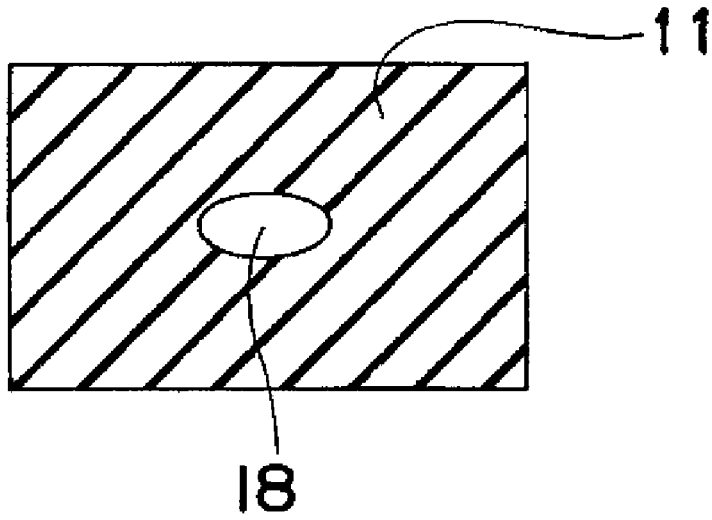
FIG. 10B is a schematic diagram showing the electrode lead-out hole formed in Reference Example 1.
Figure 10C:
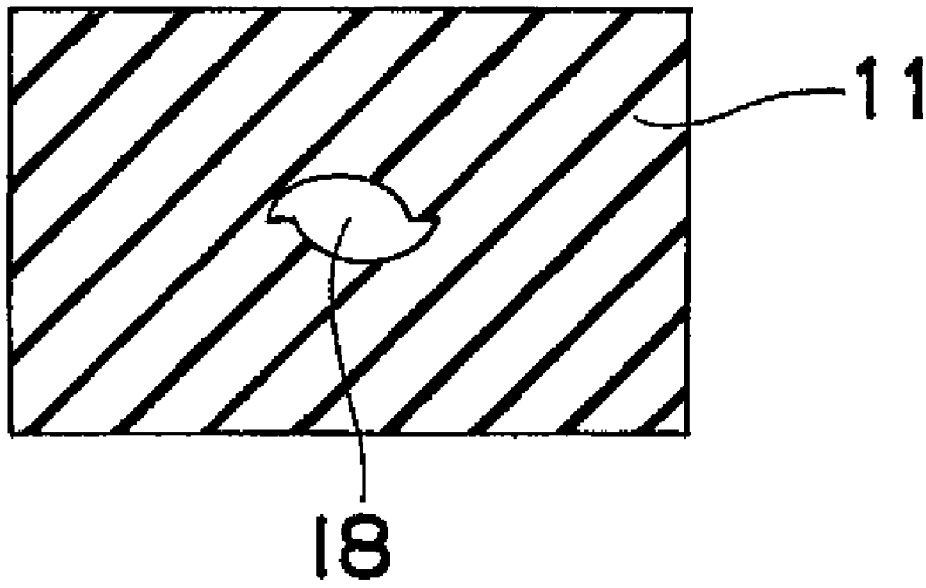
FIG. 10C is a schematic diagram showing the electrode lead-out hole formed in Reference Example 1.

As can be seen from Table 3, in samples Nos. 2, 3, 5, 6, and 9 of which carbon pins 41 had density of 1.5 g/cm$^3$ or higher, satisfactory holes of round cross section as shown in FIG. 10A was obtained. In samples Nos. 1, 5 and 7 of which carbon pins 41 had density of 1.4 g/cm$^3$, cross section of the hole was deformed as shown in FIG. 10B and FIG. 10C. In samples Nos. 4 and 7 of which pin was as thick as 1 to 2 mm, the carbon pins 41 were cracked after firing.

What is claimed is:

1. A ceramic heater comprising:

a ceramic member;

a heat generating resistive member incorporated in the ceramic member;

a pair of positive lead wire and negative lead wire connected to the heat generating resistive member; and a positive electrode lead-out section which is connected to the positive lead wire and is exposed on the surface of the ceramic member, wherein a protrusion is formed on one end face of the ceramic member, while the positive electrode lead-out section is drawn out and exposed at a plurality of openings along the side face of the protrusion, and the plurality of openings are spaced apart from each other and an external terminal can be connected to each of the exposed portions.

2. The ceramic heater according to claim 1, wherein the openings of the positive electrode lead-out section are formed at positions which oppose each other via the side wall of the protrusion.

3. The ceramic heater according to claim 1 or 2, wherein the ratio of outer diameter A of the protrusion to outer diameter B of the ceramic member is within a range of $0.4 \leqq A/B \leqq 0.88$.

4. The ceramic heater according to claim 1, wherein area of the portion where the lead-out section is exposed is in a range from $1\times10^5$ to $6.8\times10^5$ μm$^2$.

* * * * *